US011675306B2

(12) United States Patent
Shiina et al.

(10) Patent No.: US 11,675,306 B2
(45) Date of Patent: Jun. 13, 2023

(54) IMAGE FORMING APPARATUS

(71) Applicant: CANON KABUSHIKI KAISHA, Tokyo (JP)

(72) Inventors: Sachiyori Shiina, Shizuoka (JP); Daisuke Abe, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/193,328

(22) Filed: Mar. 5, 2021

(65) Prior Publication Data

US 2021/0294259 A1 Sep. 23, 2021

(30) Foreign Application Priority Data

Mar. 23, 2020 (JP) ..... JP2020-051839

(51) Int. Cl.
*G03G 21/16* (2006.01)
*G03G 15/02* (2006.01)

(52) U.S. Cl.
CPC ..... *G03G 21/1619* (2013.01); *G03G 15/0258* (2013.01)

(58) Field of Classification Search
CPC ..... G03G 21/1619; G03G 15/0258
See application file for complete search history.

(56) References Cited

U.S. PATENT DOCUMENTS

2007/0071482 A1* 3/2007 Okabe ..... G03G 21/1619 399/90
2009/0074444 A1* 3/2009 Kuze ..... G03G 15/0258 399/100

(Continued)

FOREIGN PATENT DOCUMENTS

JP 2007-72420 A 3/2007
JP 2011-158843 A 8/2011

(Continued)

OTHER PUBLICATIONS

Japanese Office Action dated Apr. 25, 2023, during prosecution of related Japanese Application No. 2020-051839 (English translation included).

*Primary Examiner* — Sandra Brase
(74) *Attorney, Agent, or Firm* — Venable LLP

(57) ABSTRACT

An image forming apparatus includes an apparatus body, a photoconductor unit, and a developing cartridge. The apparatus body includes a controller and a body-side contact portion. The photoconductor unit includes a photoconductor, a charger, and a frame body. The developing cartridge includes a developing roller, a storage medium configured to store information, and a cartridge-side contact portion. The photoconductor unit includes a first contact portion configured to be electrically connected to the body-side contact portion, a second contact portion configured to be electrically connected to the cartridge-side contact portion, and a wiring portion electrically connecting the first contact portion and the second contact portion. The photoconductor unit further includes a separating member. The separating member is arranged to separate the charger and the part of the wiring portion when viewed in the rotational axis direction of the photoconductor.

15 Claims, 10 Drawing Sheets

(56) References Cited

U.S. PATENT DOCUMENTS

| | | | | |
|---|---|---|---|---|
| 2015/0378303 | A1* | 12/2015 | Ohata | G03G 15/80 399/90 |
| 2019/0041792 | A1 | 2/2019 | Kishi | |
| 2019/0196394 | A1* | 6/2019 | Yabuki | G03G 15/0863 |
| 2020/0103790 | A1* | 4/2020 | Kishi | G03G 21/1875 |
| 2020/0272085 | A1* | 8/2020 | Shinoya | G03G 21/1619 |

FOREIGN PATENT DOCUMENTS

| | | | |
|---|---|---|---|
| JP | 2019-28345 | A | 2/2019 |
| JP | 2020-38240 | A | 3/2020 |

* cited by examiner

IMAGE FORMING APPARATUS

BACKGROUND OF THE INVENTION

Field of the Invention

The present invention relates to an image forming apparatus for forming an image on a recording medium.

Description of the Related Art

Some image forming apparatuses such as laser beam printers or LED printers are provided with a tray that can be drawn out of an apparatus body, and a plurality of components that carry out image forming processes formed as a cartridge that can be attached to the tray in a detachable manner. According to this configuration, the user can replace the cartridge easily by drawing out the tray.

Japanese Patent Application Laid-Open Publication No. 2019-028345 discloses an image forming apparatus that adopt a configuration where a developing cartridge is detachably attached to a tray-like drum unit, and the drum unit storing the developing cartridge is attached to the apparatus body. A storage medium for storing various information related to the developing cartridge is attached to the developing cartridge, and in a state where the developing cartridge is attached to the drum unit, the storage medium is electrically connected to a relay board provided at a rear portion of the drum unit. When the drum unit is inserted to the apparatus body, a contact member provided on the drum unit being electrically connected to foe relay board comes into contact with a contact member provided on the apparatus body, in which state the controller of the apparatus body can acquire information from the storage medium of the developing cartridge.

According to the apparatus disclosed in the above patent document, a charging unit provided on the drum unit and an electric wiring arranged on foe rear portion of foe drum unit are arranged close to each other, so that electromagnetic noise generated from foe charging unit may affect signal transmission through the electric wiring.

SUMMARY OF THE INVENTION

The present invention provides an image forming apparatus capable of reducing effects of electromagnetic noise on electric wiring.

According to one aspect of the invention, an image forming apparatus includes an apparatus body, a photoconductor unit, and a developing cartridge. The apparatus body includes a controller and a body-side contact portion electrically connected to the controller. The photoconductor unit includes a photoconductor, a charger configured to charge a surface of the photoconductor, and a frame body supporting the photoconductor and the charger. The photoconductor unit is detachably attached to the apparatus body in a direction orthogonal to a rotational axis direction of the photoconductor. The dev eloping cartridge includes a developing roller configured to develop an electrostatic latent image formed on the photoconductor using developer, a storage medium configured to store information, and a cartridge-side contact portion electrically connected to the storage medium. The developing cartridge is detachably attached to an attaching portion provided in the photoconductor unit. In addition, the photoconductor unit includes a first contact portion configured to be electrically connected to the body-side contact portion in a state where the photoconductor unit is attached to the apparatus body, a second contact portion configured to be electrically connected to the cartridge-side contact portion in a state where foe developing cartridge is attached to the attaching portion, and a wiring portion electrically connecting the first contact portion and the second contact portion. The frame body includes a first side frame and a second side frame that are disposed respectively at a first end side and a second end side in the rotational axis direction of the photoconductor and each extend in an attaching direction of the photoconductor unit to the apparatus body, and an upstream-side frame and a downstream-side frame that are respectively arranged on an upstream side and a downstream side of the photoconductor in the attaching direction and each supported by the first side frame and the second side frame. The first contact portion is arranged on a first surface on an outer side of the downstream-side frame such that the first contact portion is exposed outside of the photoconductor unit. A part of the wiring portion is arranged along a second surface on an inner side of the downstream-side frame. The photoconductor unit further includes a separating member that is arranged to oppose the second surface of the downstream-side frame, the separating member being arranged to separate the charger and the part of the wiring portion when viewed in the rotational axis direction of the photoconductor.

Further features of the present invention will become apparent from the following description of exemplary embodiments with reference to the attached drawings.

DESCRIPTION OF THE EMBODIMENTS

Exemplary embodiments of the present disclosure will be illustrated with reference to the drawings. In the following description, with respect to an image forming apparatus, a direction from which a user is assumed to mainly access the apparatus, that is, a side on which a front door, if any, is provided, is referred to as a front side, and a side opposite from the front side is referred to as a tear side. A left side when viewing the image forming apparatus from the front side is referred to as a left side, and a right side thereof is referred to as a right side.

A direction toward which an axis of a photoconductor extends, which according to the following embodiment is a direction from the right side of the image forming apparatus toward the left side, is referred to as direction X, the vertical direction is referred to as direction Z, and a direction orthogonal to direction X and direction Z, which according to the following embodiment is a rear direction of the image forming apparatus, is referred to as direction Y. Directions X, Y and Z are preferably orthogonal coordinate systems that are mutually orthogonal to each other. In other words, direction X and direction Y are both horizontal directions. In the following description, unless denoted otherwise, shapes of components of the image framing apparatus or positional relationships among components assume the positions or orientations taken in a state where the respective components are assembled to the image forming apparatus.

First Embodiment

(1) General Configuration of Image Forming Apparatus

Figure 1:
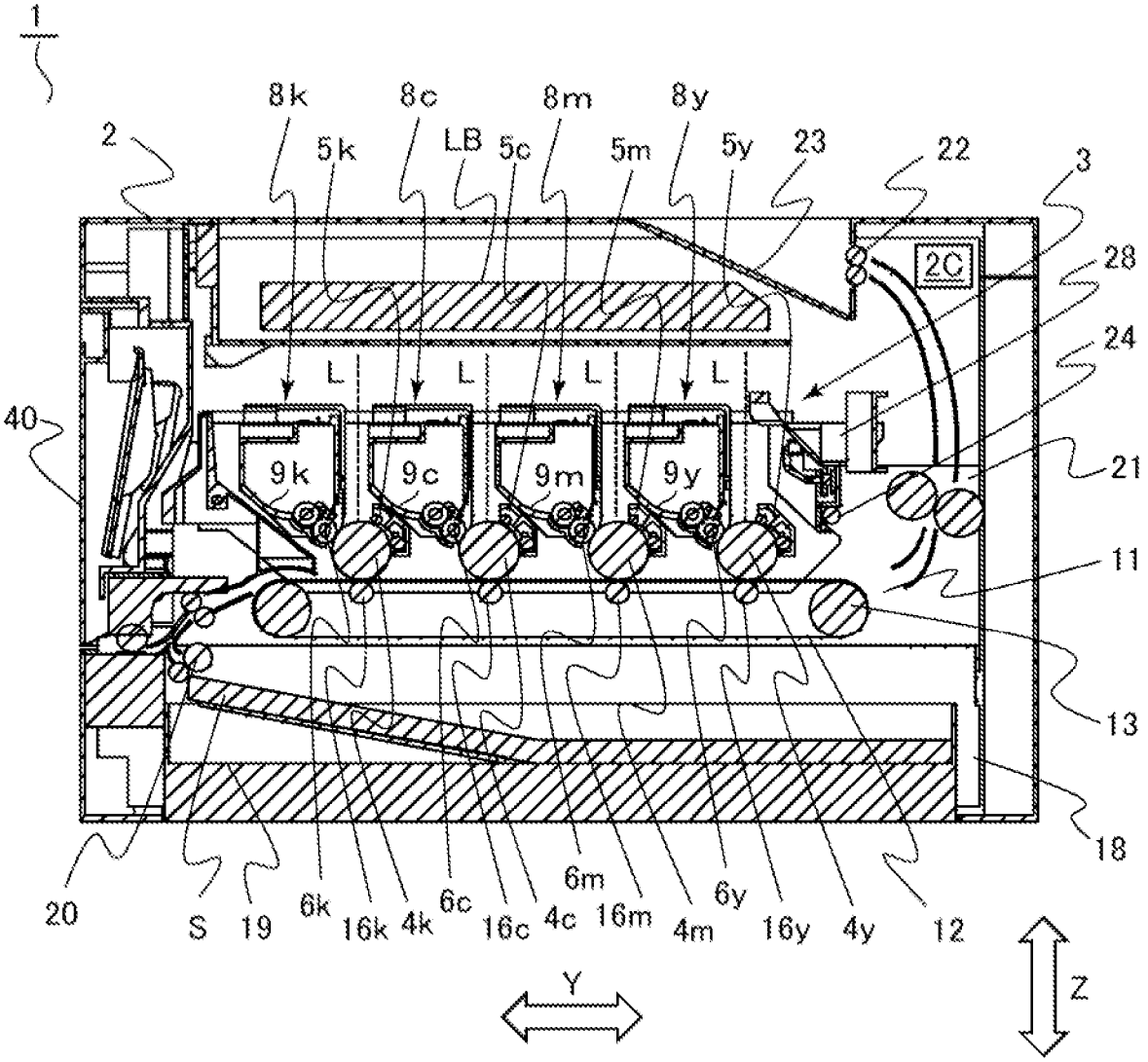
FIG. 1 is a schematic view illustrating a cross-sectional structure of an image forming apparatus according to a first embodiment.
Figure 2:
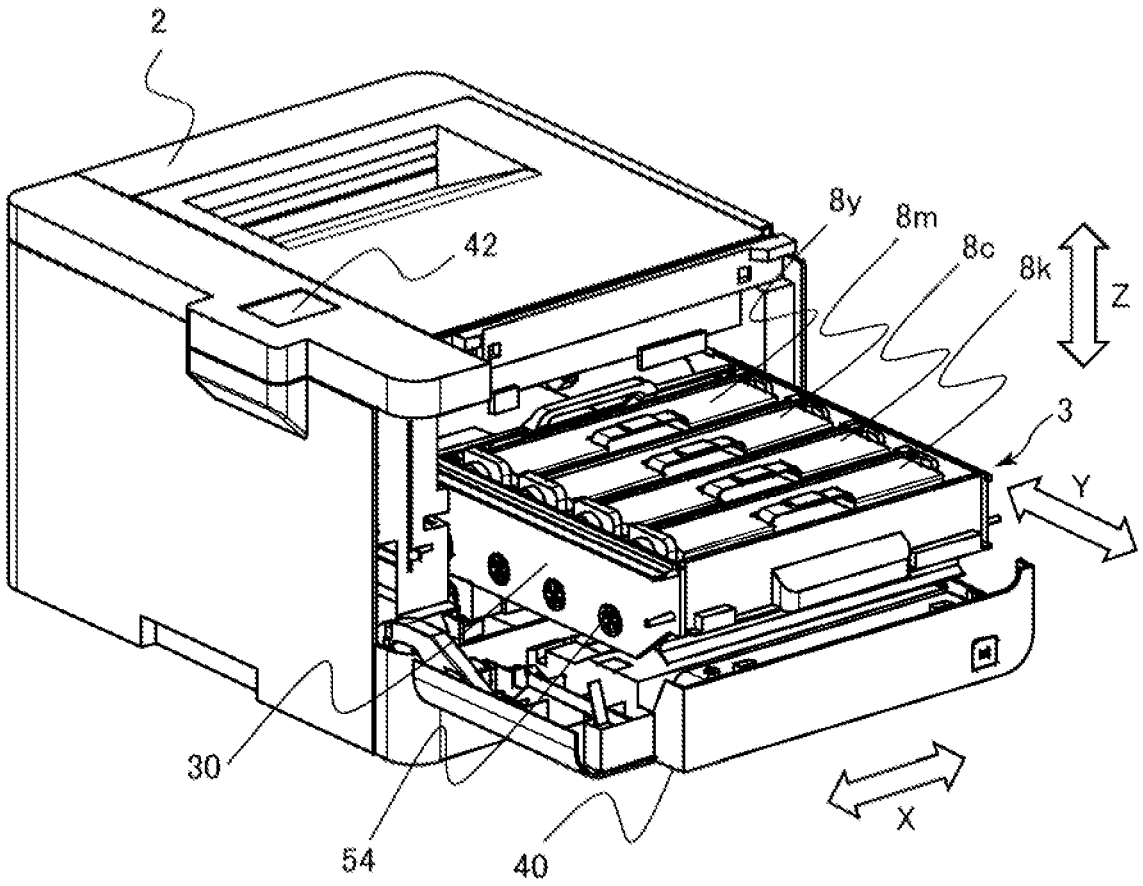
FIG. 2 is a perspective view of the image forming apparatus according to the first embodiment.

A configuration of an image forming apparatus 1 according to a first embodiment will be described. FIG. 1 is a schematic view illustrating a cross-sectional structure of the image forming apparatus 1 according to the present embodiment, and FIG. 2 is a perspective view illustrating a state where a front door 40 of the image forming apparatus 1 is open and a cartridge tray 3 is drawn out. As illustrated in FIG. 1, the image forming apparatus 1 includes an apparatus body 2, the cartridge tray 3, and developing cartridges 8*k*, 8*c*, 8*m* and 8*y* that are detachably attached to the cartridge tray 3. The image forming apparatus 1 is a four-color laser beam printer that forms an image on a recording medium through an electrophotographic process, and forms a color image on a recording medium S. Various sheets of different sizes and materials can be used as the recording medium S, such as normal paper and thick paper, plastic film, cloth, sheet subjected to surface treatment such as coated paper, and special-sized sheet material such as envelope and index sheet.

The cartridge tray 3 includes a tray frame body 30 (FIG. 2), a plurality of photosensitive drums 4*k*, 4*c*, 4*m* and 4*y* that are supported rotatably by the tray frame body 30, and charging units 5*k*, 5*c*, 5*m* and 5*y*. The photosensitive drums 4*k* to 4*y* are drum-shaped electrophotographic photoconductors, i.e., image bearing members. Cartridge storage portions 89*k*, 89*c*, 89*m* and 89*y* (FIGS. 3 and 4) serving as attaching portions to which developing cartridges are attached are provided in the cartridge tray 3 and developing cartridges 8*k* to 8*y* are stored in the cartridge storage portions 89*k* to 89*y*. The developing cartridges 8*k* to 8*y* include casings 9*k*, 9*c*, 9*m* and 9*y* that store developer (i.e., developer agent), and developing rollers 6*k*, 6*c*, 6*m* and 6*y* that perform developing processes using developer.

The front door 40 that can be opened and closed is provided on a front side of the apparatus body 2, and by opening the front door 40, as described later, the cartridge tray 3 can be drawn out from the apparatus body 2 to enable replacement of the cartridge tray 3 and the dev eloping cartridges 8*k* to 8*y*. The apparatus body 2 refers to the part of the image forming apparatus 1 excluding the cartridge tray 3 and the developing cartridges 8*k* to 8*y* and includes a frame body of the image forming apparatus 1, for example.

The inserting or drawing out of the cartridge tray 3 to or from the apparatus body 2 is guided by a body-side guide rail provided in the apparatus body 2. Tray-side guide rails 39 and 39 serving as guided portions being guided by body-side guide rails are provided on the cartridge tray 3. The tray-side guide rails 39 and 39 are projections that extend in a direction of movement of the cartridge tray 3 when it is inserted to or drawn out of the apparatus body 2, which according to the present embodiment is direction Y.

A laser scanner unit LB serving as an exposure unit is provided above the developing cartridges 8*k* to 8*y* and the cartridge tray 3 in the apparatus body 2. Further, a belt unit 11 serving as a conveyance portion is provided below the developing cartridges 8*k* to 8*y* and the cartridge tray 3 in the apparatus body 2. The belt unit 11 is formed by stretching an electrostatic attraction belt 12 having flexibility around a driving roller 13 and a tension roller 14. The electrostatic attraction belt 12 is an example of a belt member that conveys the recording medium S. The electrostatic attraction belt 12 according to the present embodiment is stretched across the driving roller 13 and the tension roller 14 in an approximately horizontal direction.

Transfer rollers 16*k*, 16*c*, 16*m* and 16*y* are provided on an inner side of the electrostatic attraction belt 12 opposing the photosensitive drums 4*k*, 4*c*, 4*m* and 4*y*. Areas where the photosensitive drums 4*k*, 4*c*, 4*m* and 4*y* oppose the respective transfer rollers 16*k*, 16*c*, 16*m* and 16*y*, i.e., nip portions formed between the photosensitive drums 4*k* to 4*y* and the electrostatic attraction belt 12, constitute transfer portions where a transfer process is carried out.

A sheet feed unit 18 is provided below the belt unit 11. The sheet feed unit 18 includes a sheet teed tray 19 on which the recording medium S is stacked and stored, and a sheet feed roller 20 that feeds the recording medium S one sheet at a time. A fixing unit 21 that carries out a fixing process is provided cm the Y-direction side of the belt unit 11. A sheet discharge unit 22 that discharges the recording medium S to an outer side of the apparatus body 2 is provided above the fixing unit 21 on an upper portion of the apparatus body 2.

(2) Image Forming Operation

An image forming operation will be described with reference to FIGS. 1 and 2. An operation for forming a full-color image is as follows. Prior to starting the image forming operation, the cartridge tray 3 having the developing cartridges 8*k* to 8*y* attached thereto is inserted to the apparatus body 2 and the front door 40 is closed, by which the attachment of the cartridge tray 3 and the developing cartridges 8*k* to 8*y* to the image forming apparatus 1 is completed.

When the front door 40 is closed, drum drive couplings not shown provided on the image forming apparatus 1 are engaged with drum couplings 54 connected to the photosensitive drums 4*k* to 4*y* provided on the cartridge tray 3. When the image forming apparatus 1 receives a command to execute image formation, the drum couplings 54 are each driven to rotate via a drive output motor and a gear not shown in the apparatus body 2, by which the photosensitive drums 4*k* to 4*y* are driven to rotate at a predetermined speed. The electrostatic attraction belt 12 is also driven to rotate at a speed corresponding to the speed of the photosensitive drums 4*k* to 4*y*. Meanwhile, the laser scanner unit LB is driven to emit light. In synchronization with the emission of light of the laser scanner unit LB, the surface of the photosensitive drums 4*k* to 4*y* are charged uniformly to predetermined polarity and potential by charging units 5*k* to 5*y*. The laser scanner unit LB scans and exposes the surface of the respective photosensitive drums 4*k* to 4*y* with laser light L corresponding to image signals of respective colors. Thereby, electrostatic latent images corresponding to image signals of respective colors are formed on the surface of the photosensitive drums 4*k* to 4*y*.

The electrostatic latent images are developed by developing rollers 6*k* to 6*y* that are driven to rotate at a predetermined speed. By this process, a yellow toner image corresponding to a yellow component of the full-color image is formed on a first photosensitive drum 4*y*. Similarly, toner images corresponding to magenta, cyan and black of the full-color image are formed respectively on second, third and fourth photosensitive drums 4*m*, 4*c* and 4*k*.

Meanwhile, the recording medium S is separated (me by one and fed at a predetermined conveyance timing from the sheet feed tray 19. Toner images of yellow, magenta, cyan and black are transferred in a superimposed manner to the recording medium S while the recording medium S passes the first to fourth photosensitive drums 4*y*, 4*m*, 4*c* and 4*k* in the named order. Thereby, a full-color non-fixed toner image composed of four colors is formed on the recording medium S.

The recording medium S to which a toner image has been transferred is subjected to a fixing process at the fixing unit 21. The fixing unit 21 includes a pair of rollers that nips and conveys the recording medium S, and a heating unit, such as a halogen lamp or an electromagnetic induction heating unit, tor heating the toner image on the recording medium S, where heat and pressure is applied to the unfixed toner image. Thereby, toner is melted, mixed and then solidified, so that a fixed image fixed to the recording medium S is obtained. The recording medium S having passed the fixing unit 21 is discharged by the sheet discharge unit 22 to a sheet discharge tray 23 provided on an upper side of the apparatus body 2.

(3) Cartridge Tray

Figure 3:
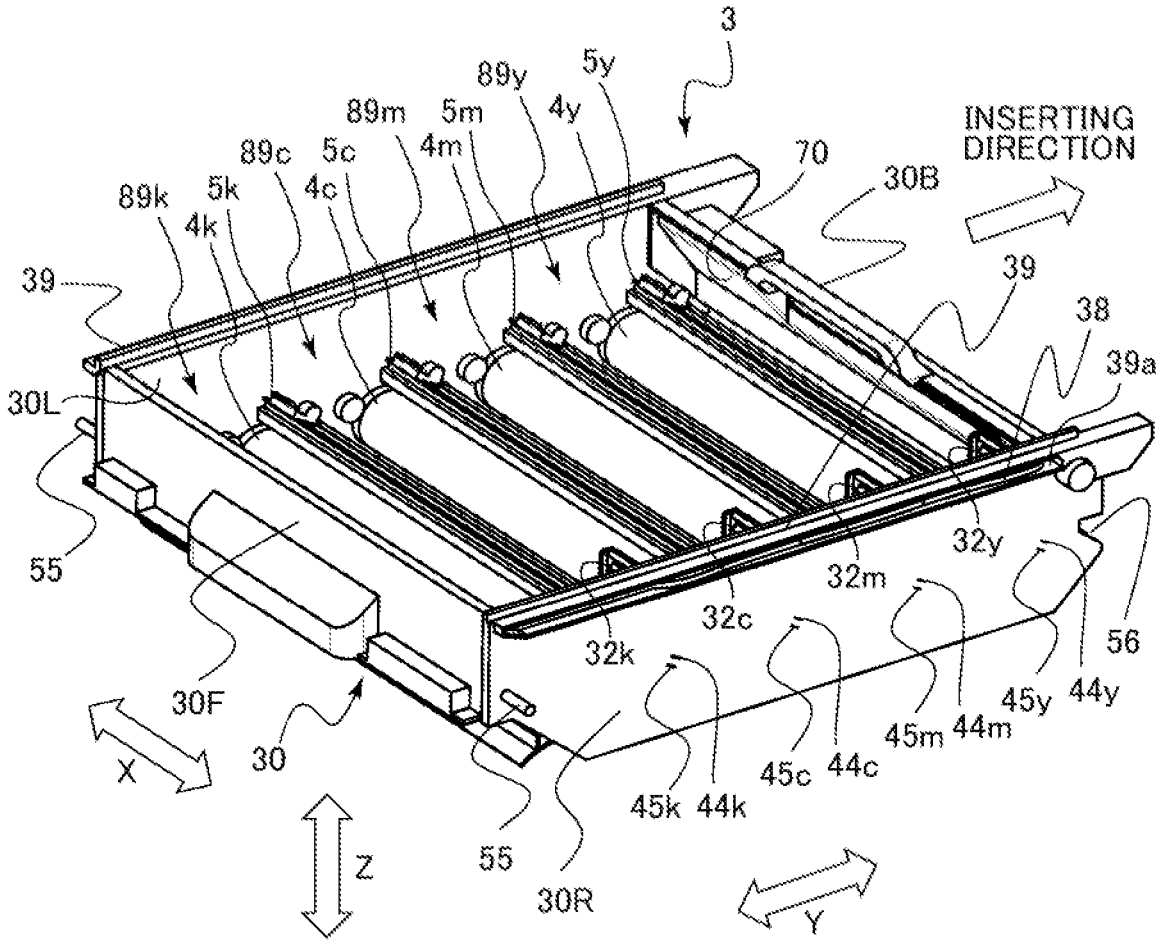
FIG. 3 is a perspective view of a cartridge tray according to the first embodiment in a state where cartridges are attached thereto.
Figure 4:
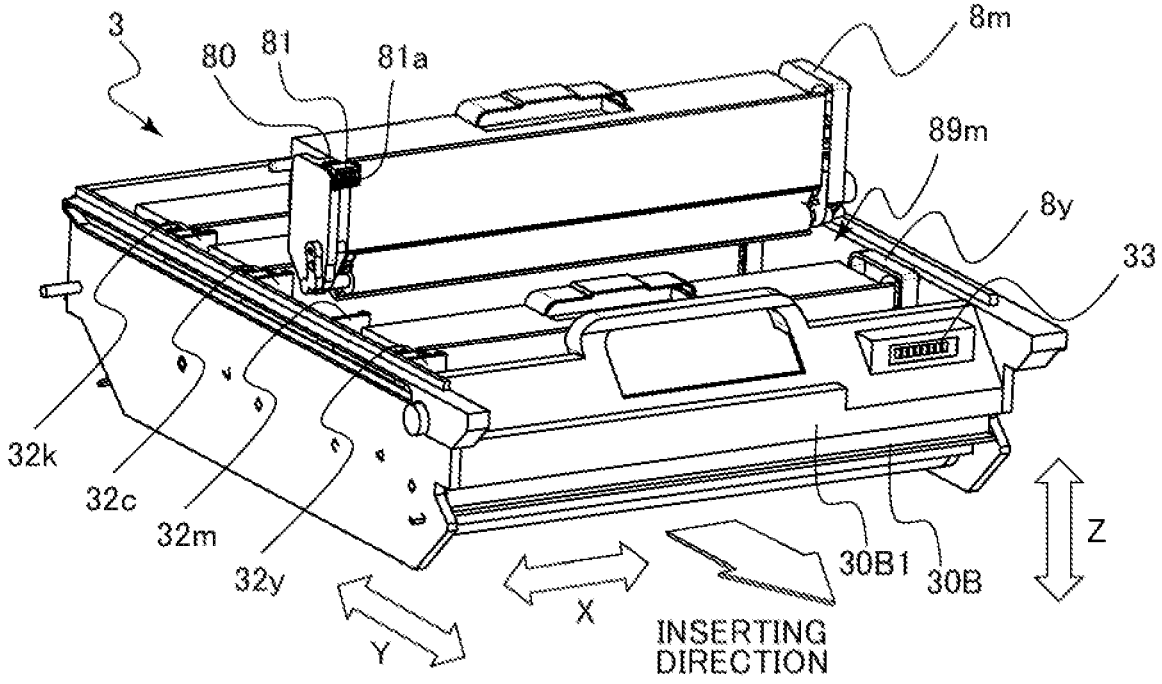
FIG. 4 is a perspective view of a cartridge tray according to the first embodiment in a state where cartridges are not attached thereto.
Figure 5:
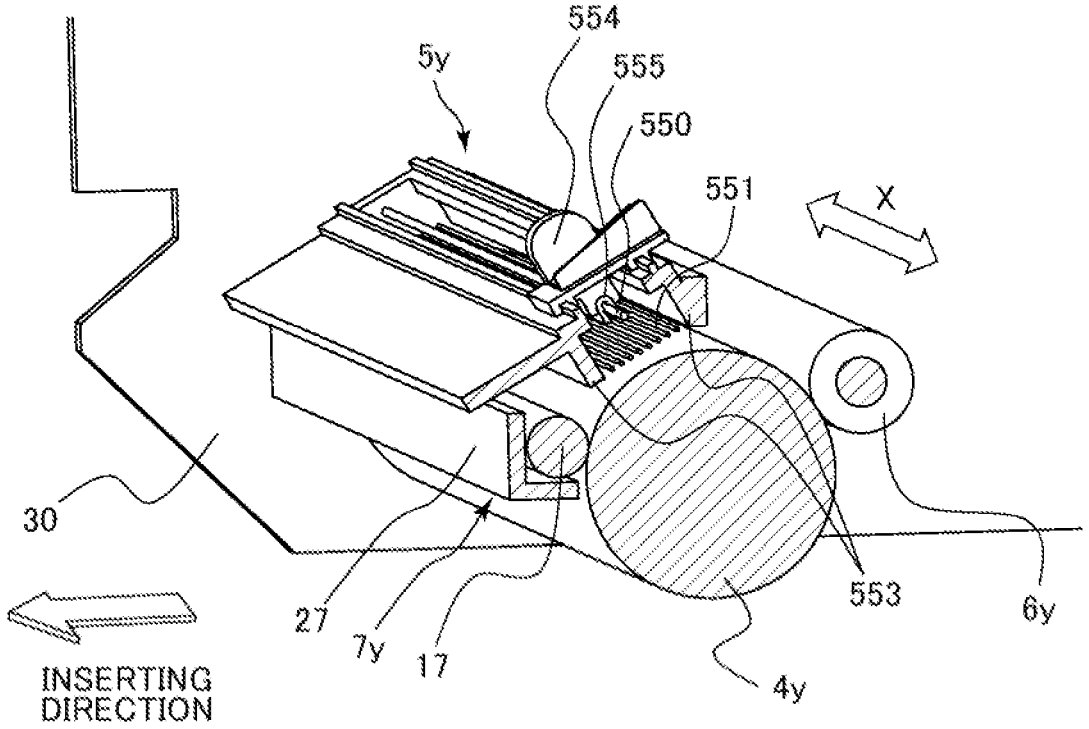
FIG. 5 is a cross-sectional view illustrating a configuration of a photosensitive drum and its surroundings of the cartridge tray according to the first embodiment.

Next, a configuration of the cartridge tray 3 according to the first embodiment will be descried with reference to FIGS. 3, 4 and 5. The cartridge tray 3 is a photoconductor unit according to the present embodiment that includes at least one photoconductor, that is, the photosensitive drums 4*k* to 4*y* in the case of the present embodiment.

FIG. 3 is a perspective view of the cartridge tray 3. The cartridge tray 3 includes the tray frame body 30, a tray through-shaft SS, the photosensitive drums 4*k* to 4*y*, and charging units 5*k* to 5*y* serving as chargers. The cartridge tray 3 further includes a cleaning frame equipped with a cleaning member, charging contacts 44*k*, 44*c*, 44*m* and 44*y* serving as processing contacts, cleaner contacts 45*k*, 45*c*, 45*m* and 45*y*, and a first contact portion 33 and second contact portions 32*k* to 32*y* that are described in detail later.

As illustrated in FIG. 3, the tray frame body 30 is a frame body that has four sides, which are a right-side portion 30R, a left-side portion 30L, a front-side portion 30F and a rear-side portion 30B. The right-side portion 30R serving as a first side frame is provided on a first end side in a longitudinal direction of the photosensitive drums 4*k* to 4*y* and extends in an inserting direction, that is, attaching direction to the apparatus body 2, of the cartridge tray 3. The left-side portion 30L serving as a second side frame is provided on a second end side in the longitudinal direction of the photosensitive drums 4*k* to 4*y* and extends in the inserting direction of the cartridge tray 3. The front-side portion 30F serving as an upstream-side frame is provided upstream of the photosensitive drums 4*k* to 4*y* in the inserting direction of the cartridge tray 3 and supported by the right-side portion 30R and the left-side portion 30L. The rear-side portion 30B serving as a downstream-side frame is provided downstream of the photosensitive drums 4*k* to 4*y* in the inserting direction of the cartridge tray 3 and supported by the right-side portion 30R and the left-side portion 30L.

The tray through-shaft 55 is a through-shaft that is supported by the right-side portion 30R and the left-side portion 30L, both end portions thereof being protruded outward of the right-side portion 30R and the left-side portion 30L. A tray positioning portion 56 is provided on a rear side of the right-side portion 30R and of the left-side portion 30L. The tray through-shaft 55 is supported by a tray shaft engagement portion (not shown) of the apparatus body 2 when being inserted to the apparatus body 2, and the tray positioning portion 56 is supported by a tray positioning shaft 24 (refer to FIG. 1) of the apparatus body 2 illustrated in FIG. 1. Thereby, the cartridge tray 3 is positioned on the apparatus body 2.

The photosensitive drums 4*k* to 4*y* are each supported by the right-side portion 30R and the left-side portion 30L and attached rotatably about a rotational axis that extends in direction X.

FIG. 4 is a perspective view of the cartridge tray 3 and the developing cartridges 8*k* to 8*y* according to the present embodiment FIG. 4 illustrates a state where one developing cartridge 8*m* is taken out and other developing cartridges 8*k*, 8*c* and 8*y* are attached to the cartridge tray 3. The developing cartridges 8*k* to 8*y* can be independently attached to or detached from four cartridge storage portions 89*k* to 89*y*, which serve as slots, provided in the cartridge tray 3.

The developing cartridge 8*m* includes a memory tag unit 80 to which a memory tag, i.e., IC tag, 81 serving as a storage medium of the present embodiment is attached. Only the memory tag unit 80 of the developing cartridge 8*m* of magenta is illustrated in FIG. 4, but similar memory tag units 80 are provided on each of the developing cartridges 8*k* to 8*y*.

The memory tag 81 is a contact-type IC chip, for example, and includes a memory contact portion 81*a* serving as an electric contact portion, i.e., cartridge-side contact portion, being exposed on the outer side of each of the developing cartridges 8*k* to 8*y*. The cartridge tray 3 is provided with second contact portions 32*k*, 32*c*, 32*m* and 32*y* (FIG. 3) serving as electric contact portions that respectively correspond to the memory contact portions 81*a* of the developing cartridges 8*k* to 8*y*. When the developing cartridges 8*k* to 8*y* are attached to the cartridge tray 3, the memory contact portions 81*a* come into contact with the second contact portions 32*k* to 32*y*, by which each memory tag 81 is connected electrically to the electric circuit of the cartridge tray 3. The wiring structure in the cartridge tray 3 will be described later.

As illustrated in FIG. 4, the first contact portion 33 serving as an electric contact portion is provided on a leading side of the cartridge tray 3 in the inserting direction, i.e., attaching direction, to the apparatus body 2. The first contact portion 33 is supported by the rear-side portion 30B of the tray frame body 30 and exposed downstream in the inserting direction through an opening portion formed on the rear-side portion 30B. In other words, the first contact portion 33 is arranged on a first surface 30B1 on an outer side of the rear-side portion 30B serving as a downstream-side frame of the tray frame body 30 so as to be exposed outside of the cartridge tray 3. Further, a body-side contact portion 28 (FIG. 1) is provided on the apparatus body 2 as an electric contact portion corresponding to the first contact portion 33. In a state where the cartridge tray 3 is inserted to a predetermined attachment position, i.e., a position capable of executing image forming operation, in the apparatus body 2, the first contact portion 33 and the body-side contact portion 28 are electrically connected, as illustrated in FIG. 1.

The apparatus body 2 of the image forming apparatus 1 includes a controller 2C illustrated schematically in FIG. 1 and a display unit 42 (FIG. 2) illustrated in FIG. 2. The body-side contact portion 28 is electrically connected to the controller 2C through a wiring provided in the apparatus body 2. The controller 2C include a processor such as a CPU and various memories and configured of a circuit board, for example, and the processor is operated based on a program according to which various processes in the image forming apparatus 1 are carried out. The controller 2C executes the image forming operation by controlling motors for driving the photosensitive drums 4*k* to 4*y* or a high-voltage board for applying bias voltage to the charging units 5*k* to 5*y*. The display unit 42 is a user interface of the image forming apparatus 1 and includes a display screen such as a liquid crystal panel.

According to the above-described configuration, in a state where the cartridge tray 3 storing the developing cartridges 8*k* to 8*y* is attached to the attachment position in the apparatus body 2, the controller 2C and the memory tag 81 are electrically connected. In this state, the controller 2C reads the information stored in the memory tag 81 of the respective developing cartridges 8*k* to 8*y* or performs information processing such as sending a signal to the memory tag 81 and storing information therein. Thereby, information such as a remaining amount of developer stored in each of the developing cartridges 8*k* to 8*y* can be displayed to the user on the display unit 42.

FIG. 5 shows a cross-sectional view the photosensitive drum 4*y* and its surroundings of the cartridge tray 3. The charging unit 5*y* is supported by the tray frame body 30 and arranged in an opposed manner with a predetermined distance therebetween so as not to be in contact with the photosensitive drum 4*y*. The charging unit 5*y* adopts a corona discharge system including a discharging wire 550, a grid 551, and a wall portion 553 on which the discharging wire 550 and the grid 551 are arranged. The discharging wire 550 is extended along direction X, which is the rotational axis direction, or longitudinal direction, of the photosensitive drum 4*y*. The grid 551 is provided between the discharging wire 550 and the photosensitive drum 4*y* and controls an amount of discharge from the discharging wire 550 to the photosensitive drum 4*y*.

When forming image, the charging unit 5*y* positively charges the surface of the photosensitive drum 4*y* uniformly. Specifically, by applying high voltage to the discharging wire 550 and the grid 551, an electric field is formed between the discharging wire 550 and the photosensitive drum 4*y*, causing corona discharge. In this state, a voltage that differs from that applied to the discharging wire 550 is applied to the grid 551, and thereby, intensity of the electric field is controlled and amount of charge of the photosensitive drum 4*y* is controlled.

Further, a cleaner 554 for cleaning the discharging wire 550 is provided on the charging unit 5*y*. The cleaner 554 is provided slidably along direction X by being guided by a guide portion 553*a* (FIG. 8A) provided on an upper edge of the wall portion 553. A wiping portion 555 that nips the discharging wire 550 is provided at a tip of the cleaner 554. When the user operates the cleaner 554, the wiping portion 555 slides in direction X, which is the direction in which the discharging wire 550 is stretched, and cleans the discharging wire 550.

Further, a cleaning unit 7*y* for cleaning the photosensitive drum 4*y* is provided on the cartridge tray 3. As illustrated in FIG. 5, the cleaning unit 7*y* includes a cleaning roller 17 serving as a cleaning member, and a cleaning frame 27 fixed to the tray frame body 30 and storing the cleaning roller 17. The cleaning roller 17 is supported by the cleaning frame 27 at a position where the cleaning roller 17 is in contact with the photosensitive drum 4*y*, and is rotatable around a rotational axis extending in direction X. The cleaner contacts 45*k*, 45*c*, 45*m* and 45*y* (refer to FIG. 3) are provided on a side of the right-side portion 30R and are connected electrically with the cleaning roller 17. The cleaner contacts 45*k* to 45*y* are exposed on a right-side surface of the cartridge tray 3 and come into contact with cleaner contacts not shown in the apparatus body 2, by which the cleaning roller 17 is electrically connected with the apparatus body 2. Thereby, the cleaning roller 17 effectively removes waste developer that has not been transferred during the image forming process and that remains on the surface of the photosensitive drum 4.

Charging units 5*k*, 5*m* and 5*c* and cleaning units 7*k*, 7*m* and 7*c* (FIG. 1) having a similar configuration as the charging unit 5*y* and the cleaning unit 7*y* are provided on the cartridge tray 3 in correspondence with the respective photosensitive drums 4*k*, 4*m* and 4*c*. The charger for charging the photoconductor is not limited to the corona discharge system mentioned earlier, and charging rollers that contact the photosensitive drums 4*k* to 4*y* can be used, for example. In the present embodiment, a cleaning roller is used as the cleaning member, but the cleaning member is not always necessary, and in some cases, a different type of cleaning member such as a rubber blade or a sheet can be used.

(4) Electric Wiring and Shielding Wall of Cartridge Tray

Next, a configuration of contacts, electric wiring and shielding wall of the cartridge tray 3 will be described with reference to FIGS. 6, 7, 8A and 8B.

Figure 6:
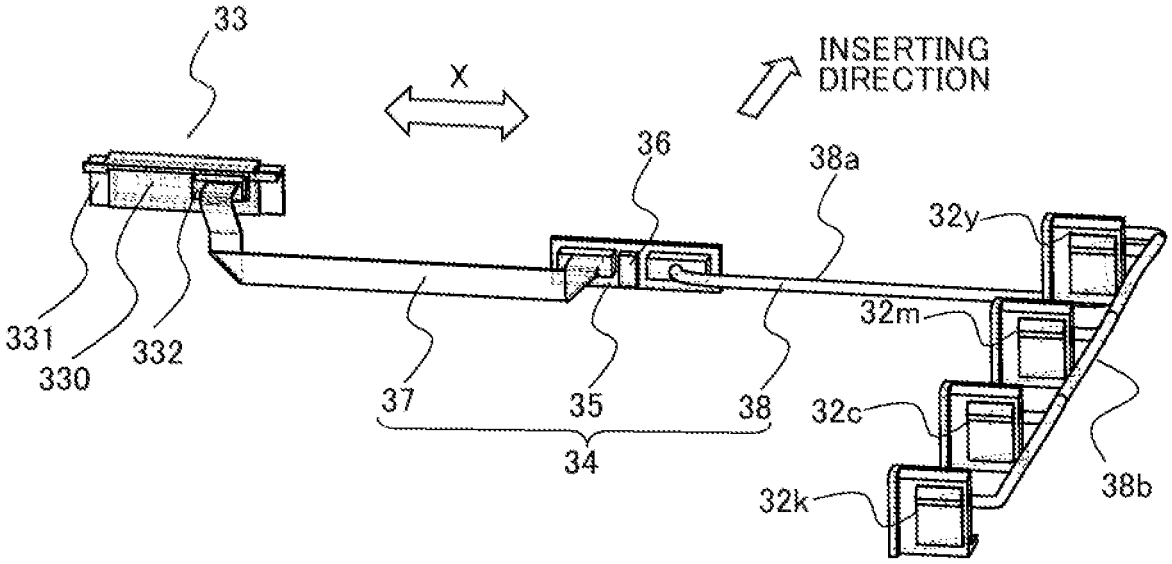
FIG. 6 is a view illustrating contact portions and electric wiring of the cartridge tray according to the first embodiment.

FIG. 6 illustrates contacts and electric wiring provided on the cartridge tray 3. The cartridge tray 3 includes, in addition to the second contact portions 32*k* to 32*y* and the first contact portion 33 mentioned above, a relay board 35 equipped with an IC chip 36 and electric wirings 37 and 38. The relay board 35 is electrically connected to the first contact portion 33 through the electric wiring 37 serving as a first wiring, and electrically connected to the second contact portions 32*k* to 32*y* through the electric wiring 38 serving as a second wiring. The electric wirings 37 and 38 and the relay board 35 are provided in the cartridge tray 3 serving as a photoconductor unit and constitute a wiring portion 34 that electrically connects the first contact portion 33 and the second contact portions 32*k* to 32*y*.

A second contact portion 33 is configured by mounting a contact board 330 provided with a terminal, i.e., electrical contact surface, that contacts and communicates with a terminal of the body-side contact portion 28 (FIG. 1) to a contact frame body 331 supported by the tray frame body 30 of the cartridge tray 3. The contact board 330 is fixed to the contact frame body 331 by an arbitrary method, such as bonding, double sided tape, or heat staking. A first end of the electric wiring 37 is connected to a connector part 332 provided on a tear side of the electrical contact surface of the contact board 330, and a second end of the electric wiring 37 is connected to the relay board 35.

The IC chip 36 is a storage medium that stores information related to the photosensitive drums 4*k* to 4*y*. In other words, the IC chip 36 serves as a second storage medium while the memory tag 81 on the developing cartridges 8*k* to

8*y* serves as a first storage medium. The IC chip 36 is attached to fire relay board 35.

Figure 8A:
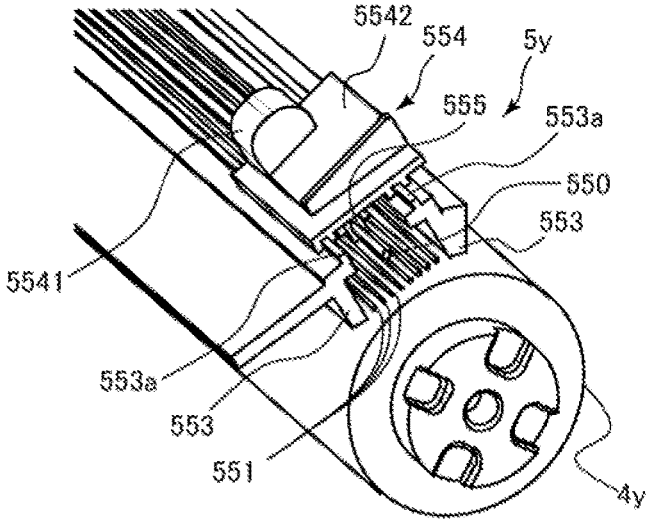
FIG. 8A is a perspective view of a charging unit according to the first embodiment.
Figure 8B:
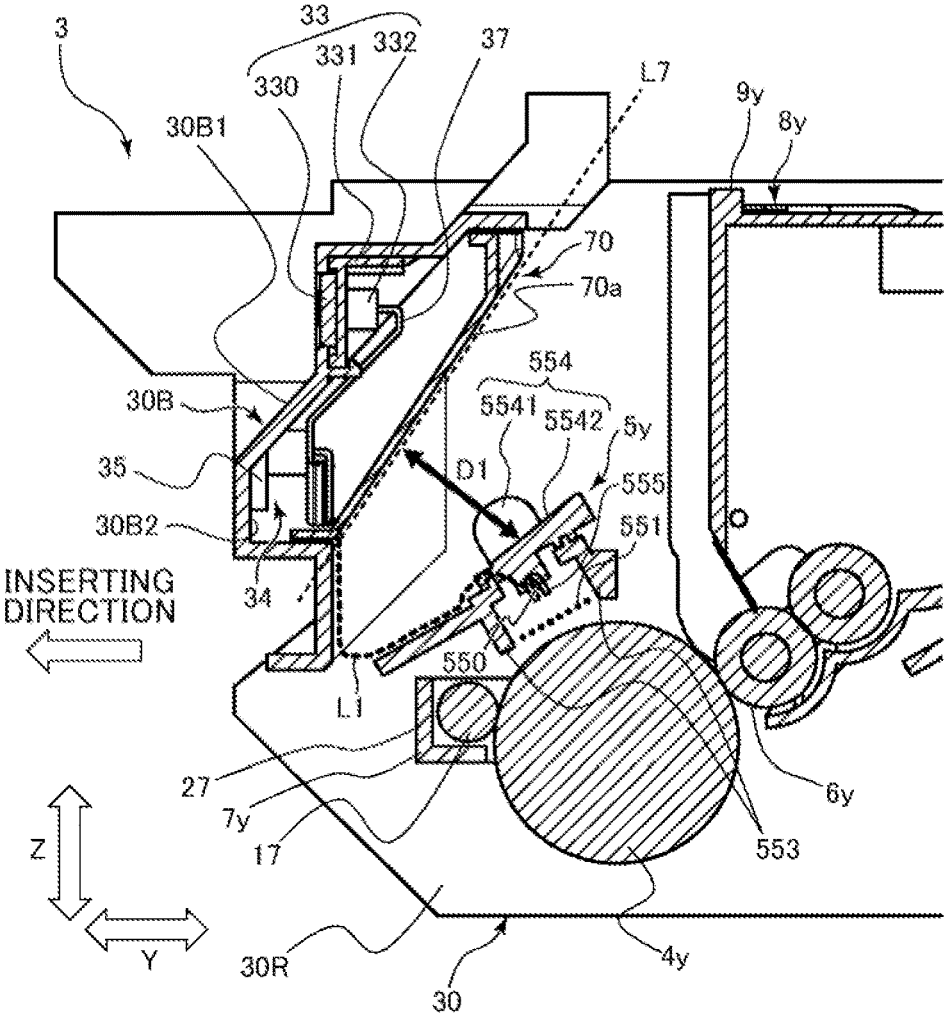
FIG. 8B is a cross-sectional view of the cartridge tray taken at line A-A of FIG. 7.

The relay board 35 is positioned on an inner side of the rear-side portion 30B of the cartridge tray 3 (refer also to FIG. 8B). A first end of the electric wiring 38 is connected to the relay board 35. A second end of the electric wiring 38 is branched into four, which are respectively connected to the second contact portions 32*k* to 32*y*. A portion 38*b* of the electric wiring 38 extends in direction Y in a groove portion 39*a* (refer to FIG. 3) that is formed along direction Y within a tray-side guide rail 39 of the cartridge tray 3. That is, the relay board 35, the electric wiring 37 and the portion 38*a* of the electric wiring 38 are arranged along a surface 30B2 arranged upstream in the insetting direction with respect to a frame, i.e., the rear-side portion 30B, that forms the downstream-side surface of the tray frame body 30 in the insetting direction, i.e., attaching direction, of the cartridge tray 3. That is, the portion 38*b* of the wiring portion 34 according to the present embodiment is arranged along a second surface on an inner side of the rear-side portion 30B serving as the downstream-side frame of the tray frame body 30.

Now, a positional relationship between the wiring portion 34 and the charging unit 5*y* will be described. The charging unit 5*y* is positioned most downstream in the inserting direction of the cartridge tray 3 among the four charging units 5*k* to 5*y* on the cartridge tray 3, and it is arranged closest to the relay board 35, the electric wiring 37 and the first contact portion 33.

As described earlier, the discharging wire 550 of the charging unit 5*y* extends along direction X which is the longitudinal direction of the photosensitive drum 4*y*. Meanwhile, the first contact portion 33 and the relay board 35 are supported by the rear-side portion 30B of the cartridge tray 3, both of which are positioned to overlap with the range in which the discharging wire 550 extends in terms of direction X. Therefore, the whole of the electric wiring 37 and a part of the electric wiring 38 are positioned within a range in which the discharging wire 550 is disposed in direction X. In other words, at least a part of the wiring portion is positioned within the range in which the charger is provided in the longitudinal direction of the photoconductor.

More specifically, more than half the length of the electric wiring 37 extends approximately in direction X between the relay board 35 and the first contact portion 33. Further, the portion 38*a* of the electric wiring 38 extending from the relay board 35 toward the groove portion 39*a* (refer to FIG. 3) of the tray-side guide rail 39 also extends approximately in direction X. It is also possible to change a wiring path of the electric wiring 38 so that the entire electric wiring 38 is arranged within the range in which of the discharging wire 550 is provided in direction X.

As described, in a configuration where the wiring portion 34 and the charging unit 5*y* of the cartridge tray 3 are arranged in approximation, it is desirable to consider that electromagnetic noise generated in the charging unit 5*y* might hamper the signal transmitted through the wiring portion 34. The present embodiment adopts a configuration where the user can operate the cleaner 554 to clean the discharging wire 550, so that there is a possibility that the user's hand may contact the wiring portion 34.

Figure 7:
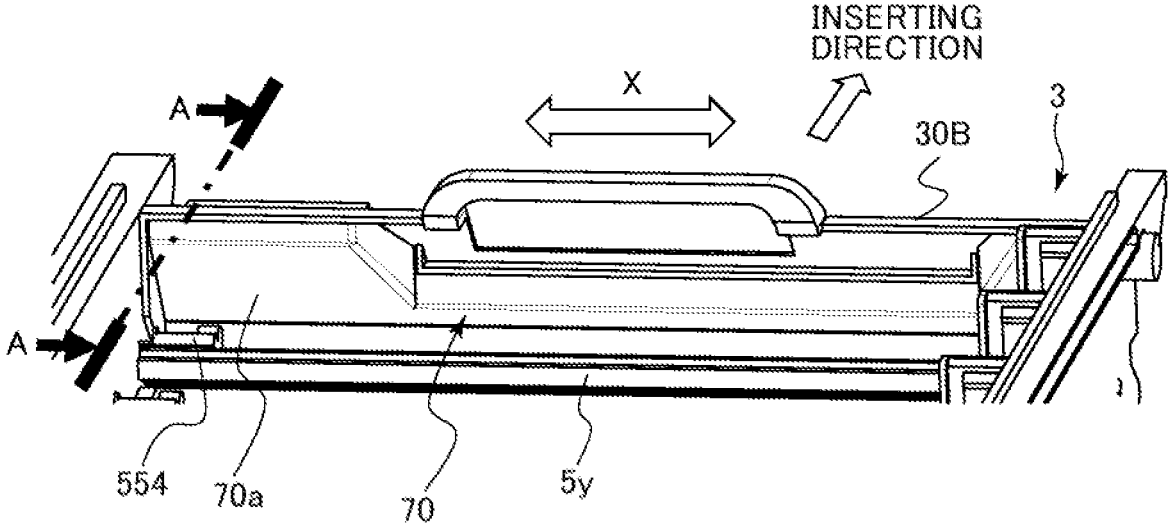
FIG. 7 is a view illustrating a shielding wall of the cartridge tray according to the first embodiment.

As illustrated in FIGS. 7 and 8B, according to the present embodiment, a shielding wall 70 serving as a separating member or a shielding member, is provided on the cartridge tray 3. FIG. 7 is a perspective view illustrating the cartridge tray 3 with the developing cartridge 8*y* removed, viewed from the upstream side in the inserting direction, i.e., attaching direction, to the apparatus body 2. FIG. 8B is a cross-sectional view of the cartridge tray 3 taken at line A-A of FIG. 7, that is, a position passing the first contact portion 33.

As illustrated in FIG. 7, the shielding wall 70 is attached to an inner side of the rear-side portion 30B, that is, upstream in the inserting direction. The shielding wall 70 is a plastic plate member that covers at least a part of the wiring portion 34 when viewed from the upstream side in the inserting direction. Specifically, the shielding wall 70 according to the present embodiment covers the connector part 332 of the first contact portion 33, the entire electric wiring 37, the entire relay board 35 and the portion 38*a* (FIG. 6) that extends approximately in direction X of the electric wiring 38.

As illustrated in FIG. 8B, when viewed in direction X, the connector part 332, the electric wiring 37 and the relay board 35 are positioned within a space, i.e., wiring space, surrounded by the rear-side portion 30B and the shielding wall 70. The charging unit 5*y* is positioned at a side opposite from a wiring space with tire shielding wall 70 interposed therebetween. The shielding wall 70 serving as a separating member or a shielding member, is arranged to separate the charger and at least a part of the wiring portion when viewed in direction X, which is the longitudinal direction of the photosensitive drum 4*y*.

By providing the shielding wall 70 as described above, a creepage distance L1 between the charging unit 5*y* and electric members on the cartridge tray 3, which are the connector part 332, the electric wiring 37 and the relay board 35, can be ensured. Therefore, the possibility of electromagnetic noise generated from the charging unit 5*y* affecting the signal transmission through the wiring portion 34 and the first contact portion 33 can be reduced.

Further, the shielding wall 70 can prevent the user's hands from touching the wiring portion 34 and the connector part 332 when the user operates the cleaner 554. Thus, the possibility of electric components being damaged during cleaning of the charging unit 5*y* can be reduced.

Now, the positional relationship between the shielding wall 70 and the cleaner 554 will be described in detail. As illustrated in FIG. 8A, the cleaner 554 includes a surface 5542, i.e., third surface according to the present embodiment, that spreads in a direction intersecting the longitudinal direction of the photosensitive drum 4*y* when viewed from above, and a projected portion 5541 that protrudes upward from the surface 5542. The projected portion 5541 is a portion that is pinched by the user's lingers operating the cleaner 554 and receiving operating force in direction X. The surface 5542 is a surface on which a user's fingernail touches when the user operates the projected portion 5541 using his/her fingers. The surface 5542 extends across the opening portion that extends between the wall portions 553 and 553 in direction X and has a function to prevent the user's finger from touching the discharging wire 550. As illustrated in FIG. 8B, the shielding wall 70 opposes the charging unit 5*y* and the cleaner 554 at a surface 70*a*, that is, fourth surface according to the present embodiment, positioned upstream in the inserting direction of the cartridge tray 3.

The shielding wall 70 should preferably be arranged so that a space is formed between the shielding wall 70 and the cleaner 554 that widens toward the upper side. Specifically, a distance D1 from the surface 70*a* of the shielding wall 70 to the surface 5542 of the cleaner 554 measured in a direction perpendicular to a dashed line L7 is increased (i.e., becomes larger) from the lower side toward the upper side in the direction along the surface 70*a*, that is, the direction of the dashed line L7, of the shielding wall 70 in the state illustrated in FIG. 8A viewed in direction X. According to this arrangement, the visibility of the cleaner 554 when viewed from above improves compared to a configuration where the distance D1 is reduced toward the upper side. Further, the workability of the user accessing the cleaner 554 from above to operate the cleaner 554 is improved since the opening on the upper side is widened.

Further, since the surface 70*a* of the shielding wall 70 opposed to the charging unit 5*y* and the cleaner 554 extends approximately in parallel to direction X, as illustrated in FIG. 7, the surface 70*a* also serves as a guide surface while the user operates the cleaner 554. Therefore, it is preferable for the surface 70*a* to cover half or more of the area in which the cleaner 554 is capable of moving in direction X, and it is even more preferable tor the surface 70*a* to cover the whole area in which the cleaner 554 is capable of moving.

Modified Example

In the present embodiment, the shielding wall 70 is formed of plastic, which is dielectric material or insulator. The material of the shielding wall 70 is not limited to plastic, and it can also be formed for example of a metal plate, which is a conductor. In that case, it is preferable that the shielding wall 70 formed of a metal plate is connected to ground potential via a metal frame of the apparatus body 2, in a state where the cartridge tray 3 is attached to the apparatus body 2. Further, the shielding wall 70 formed of a metal plate can also be a member that is electrically insulated, i.e., in a floating state, from ground potential.

Further, the separating member, i.e., shielding member, can be configured to cover at least a part of the wiring portion 34 that overlaps with the area in which fee charging unit 5*y* is disposed in direction X when viewed from the upstream side in the inserting direction of the cartridge tray 3. For example, if a wiring member having a high shielding performance is used as one of the electric wirings 37 and 38, the separating member, i.e., shielding member, can be arranged to expose the corresponding wiring member and cover the other one of the electric wirings 37 and 38. The shielding wall 70 is not required to cover the wiring space in an airtight manner, and an opening portion can be formed, for example, as long as the shielding wall 70 ensures a creepage distance between the charging unit 5*y* and the electronic components on the cartridge tray 3 compared to the case where the shielding wall 70 is not provided.

The shielding wall 70 is capable of protecting the wiring portion 34 at least physically, even in a case where the charging unit 5*y* docs not include the cleaner 554 or in a case where the electromagnetic noise reduction effect of the shielding wall 70 cannot be expected. That is, even in a case where the user works near the photosensitive drum 4*y* through the opening portion formed on the upper side of the photosensitive drum 4*y*, such as when replacing the developing cartridge 8*y*, the shielding wall 70 can reduce the possibility of the user's hand touching the wiring portion 34 and thereby damaging the wiring portion 34.

Second Embodiment

An image forming apparatus according to a second embodiment will be described. The configuration of a separating member or a shielding member according to the present embodiment differs from the first embodiment. The components denoted with the same reference numbers as the first embodiment are assumed to have the same configuration and effect as according to the first embodiment.

Figure 9:
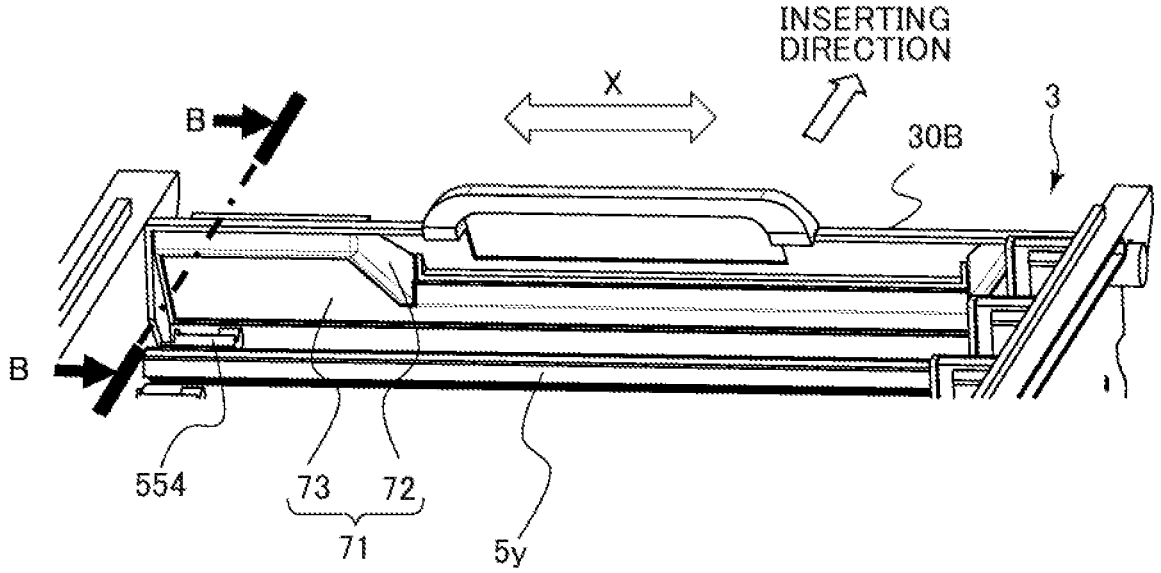
FIG. 9 is a view illustrating a shielding wall of a cartridge tray according to a second embodiment.
Figure 10:
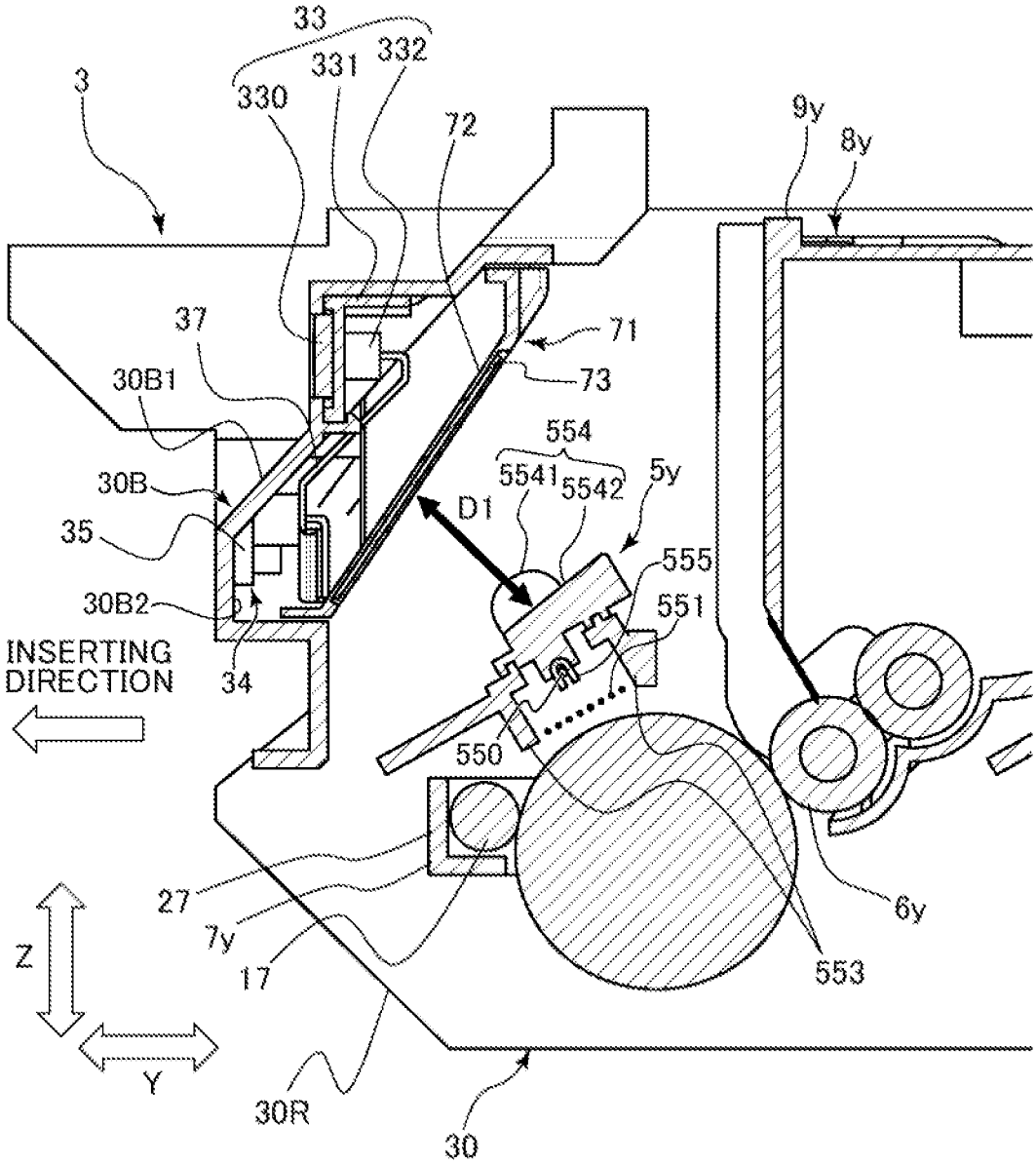
FIG. 10 is a cross-sectional view of the cartridge tray taken at line B-B of FIG. 9.

FIG. 9 is a perspective view illustrating a shielding wall 71 serving as a separating member or a shielding member, disposed on the cartridge tray 3 according to the present embodiment, and FIG. 10 illustrates a cross-sectional view of the cartridge tray 3 taken at line B-B of FIG. 9, that is, position passing through the first contact portion 33.

As illustrated in FIGS. 9 and 10, the shielding wall 71 adopts a dual structure, i.e., two-layer structure, where a base cover 72 formed of plastic and a shielding metal plate 73 formed of metal are overlapped. The shielding metal plate 73 is attached to rate side of the base cover 72 opposed to the charging unit 5*y*, which is a side opposite to the surface opposed to the relay board 35 and the connector part 332 of the first contact portion 33. The shielding metal plate 73 can be fixed to the base cover 72 by an arbitrary fixing method, such as by providing claw-shaped members to the shielding metal plate 73 and engaging the members to holes formed on the base cover 72, or by using double sided tape or adhesive bond. Further, a ground wiring is connected to the shielding metal plate 73, and in a state where the cartridge tray 3 is attached to the apparatus body 2, the shielding metal plate 73 is electrically grounded, i.e., connected to ground potential through the ground wiring and the metal frame of the apparatus body 2.

Similar to the shielding wall 70 of the first embodiment, the shielding wall 71 is attached to an inner side, that is, upstream side in the inserting direction, of the rear-side portion 30B, and arranged to cover at least a part of the wiring portion 34 when viewed from the upstream side in the inserting direction. As illustrated in FIG. 10, the connector part 332, the electric wiring 37 and the relay board 35 are positioned in a space, i.e., wiring space, surrounded by the tear-side portion 30B and the shielding wall 71 in the cross-section viewed in direction X. The charging unit 5*y* is positioned on an opposite side of fire shielding wall 71 as the wiring space. In other words, the shielding wall 71 serving as the separating member, i.e., shielding member, is arranged to separate the charger and at least a part of fire wiring portion when viewed in direction X corresponding to the longitudinal direction of the photosensitive drum 4*y*.

The shielding wall 71 arranged in the above-mentioned manner can ensure a creepage distance L1 between the charging unit 5*y* and electronic components on the cartridge tray 3, which are the connector part 332, the electric wiring 37 and the relay board 35. Thereby, the possibility of electromagnetic noise generated in the charging unit 5*y* hampering the transmission of signals through the wiring portion 34 and the first contact portion 33 can be reduced.

According to the present embodiment adopting the shielding wall 71 having a dual structure, as illustrated in FIG. 10, the base cover 72 formed of plastic is arranged on the side having the electric wiring 37 and the shielding metal plate 73 formed of metal is arranged on the side having the charging unit 5*y*. Therefore, the base cover 72 formed of plastic enables to reduce the possibility of the electric wiring 37 touching the metal edge of the shielding metal plate 73 during assembly or while the cartridge tray 3 is moved. Further, a recessed shape recessed to store the shielding metal plate 73 is provided on the side of the base cover 72 facing the charging unit 5*y*, so that at least a part of the edge of the shielding metal plate 73 is stored in the recess. In other words, the base cover 72 is arranged near the edge of the shielding metal plate 73 also on the side facing the charging unit 5*y*. Thereby, the base cover 72 enables to reduce the possibility of the user's hand touching the edge of the shielding metal plate 73.

In comparison with the shielding wall 70 composed of a single component described in the first embodiment, the use of the shielding wall 71 adopting a dual structure composed of the plastic component and the metal plate component described in the present embodiment enables to realize both improved noise shielding property by the metal plate and protection of the metal edge of the metal plate by plastic.

Furthermore, the surface of the shielding wall 71 opposed to the charging unit 5*y* and the cleaner 554, i.e., fourth surface, is arranged so that the distance D1 from the shielding wall 71 to the surface 5542, i.e., third surface, of the cleaner 554 increases from the lower side toward the upper side. The fourth surface of the present embodiment is composed of the shielding metal plate 73. According to this arrangement, the visibility of the cleaner 554 when viewed from above can be improved, and the workability of the user accessing the cleaner 554 from above and operating the cleaner 554 can also be improved. The surface of the shielding wall 71 opposed to the charging unit 5*y* and the cleaner 554 extends approximately in parallel to direction X, so that foe surface also functions as a guide surface when the user operates the cleaner 554.

The present embodiment has illustrated the shielding wall 71 as adopting a dual structure of metal plate and plastic, but the present disclosure is not limited to this structure, and for example, a conductive wire can be used instead of the metal plate, or the base cover 72 formed of plastic with metal plating thereon can be used.

Other Embodiments

The first and second embodiments have illustrated a configuration where the first contact portion 33 and the four second contact portions 32*k* to 32*y* on the cartridge tray 3 are arranged on opposite sides of a center position of the cartridge tray 3 in direction X. Further, the direction in which the electric wiring 37 extends front the relay board 35 toward the first contact portion 33 and the direction in which the electric wiring 38 extends from the relay board 35 toward the second contact portions 32*k* to 32*y* are heading to opposite sides in terms of direction X (FIG. 6). The present disclosure is not limited thereto, and a configuration can be adopted where the first contact portion 33 and the second contact portions 32*k* to 32*y* are arranged on the same side with respect to the center position in direction X of the cartridge tray 3. Further, the electric wiring 37 extending from the relay board 35 toward the first contact portion 33 and the electric wiring 38 extending from the relay board 35 toward the second contact portions 32*k* to 32*y* can be headed toward the same side in terms of direction X. In that case, the shielding wall 70 or 71 is not necessarily arranged to cover the entire length of the tear-side portion 30B with respect to direction X, and for example, they can be provided for a minimum length covering the electric wiring 38 and 37 and the relay board 35.

As for the first contact portion 33, a contact portion configured of an electric board having an electrical contact surface has been described, but the present disclosure is not limited thereto, and any component capable of allowing electric connection, such as a drawer connector, can be adopted. Regarding the configuration for maintaining electric connection, a float mechanism that can be displaced according to the position of a counterpart to which the electric contact is to be connected is adoptable in a structure where the positional accuracy of respective contacts is dispersed.

The first and second embodiments illustrate a configuration where the developing cartridges are detachably attached to the cartridge tray 3 serving as a photoconductor unit including a photoconductor. The present disclosure is not limited thereto, and for example, a configuration where the process cartridge including a photoconductor and a developing roller is detachably attached to a tray not having a photoconductor can also be adopted.

Further, the electrostatic attraction belt 12 according to the first and second embodiments is one example of a belt member equipped in the image forming apparatus, and for example, the present technology can also be applied to an image forming apparatus equipped with an intermediate transfer belt serving as an intermediate transfer body.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-051839, filed on Mar. 23, 2020, which is hereby incorporated by reference herein in its entirety.

What is claimed is:

1. An image forming apparatus comprising:

an apparatus body including a controller and a body-side contact portion electrically connected to the controller;

a photoconductor unit detachably attached to the apparatus body in an attaching direction, the photoconductor unit including:

a plurality of photoconductors aligned in the attaching direction and including a first photoconductor which is rotatable about a rotational axis extending in a direction orthogonal to the attaching direction and which is provided furthest downstream among the plurality of photoconductors in the attaching direction, a plurality of chargers, respective ones of the plurality of chargers corresponding to respective ones of the plurality of photoconductors, each charger of the plurality of chargers being configured to charge a surface of the corresponding one of the plurality of photoconductors, the plurality of chargers including a first charger configured to charge the surface of the first photoconductor, a plurality of cleaners movable in a direction of the rotational axis and configured to clean respective ones of the plurality of chargers while being moved in the direction of the rotational axis, the plurality of the cleaners including a first cleaner configured to clean the first charger and to be opposite to the first photoconductor with respect to the first charger in a direction orthogonal to the rotational axis, and a frame body supporting the plurality of photoconductors, the frame body including a first side frame and a second side frame which are disposed at a first end side and a second end side, respectively, in the direction of the rotational axis, and each of which extends in the attaching direction; and a plurality of developing cartridges detachably attached to the photoconductor unit, each of the plurality of developing cartridges including:

a developing roller configured to develop an electrostatic latent image formed on a corresponding one of the plurality of photoconductors by supplying developer thereto, a storage medium configured to store information, and a cartridge-side contact portion electrically connected to the storage medium, wherein the photoconductor unit further includes:

a first contact portion configured to be electrically connected to the body-side contact portion in a state where the photoconductor unit is attached to the apparatus body, the first contact portion being provided at a position which is closer to the first end side than to the second end side in the direction of the rotational axis and which is on a downstream end side of the photoconductor unit in the attaching direction, a plurality of second contact portions each of which is configured to be electrically connected to the cartridge-side contact portion of a corresponding one of the plurality of developing cartridges in a state where the plurality of developing cartridges are attached to the photoconductor unit, the plurality of second contact portions being provided on the second end side in the direction of the rotational axis and which are upstream of the first contact portion in the attaching direction, a wiring portion electrically connecting the first contact portion to each of the plurality of second contact portions, a part of the wiring portion being provided downstream of the rotational axis of the first photoconductor in the attaching direction and extends from the first contact portion toward the second end side in the direction of the rotational axis, and wall provided between the part of the wiring portion and the first cleaner in a cross-section of the photoconductor unit perpendicular to the rotational axis when the first cleaner is at a position the same as a position of the part of the wiring portion in the direction of the rotational axis.

2. The image forming apparatus according to claim 1, wherein the wall extends in the direction of the rotational axis.

3. The image forming apparatus according to claim 1, wherein the first charger includes a discharging wire which extends in the direction of the rotational axis and which is apart from the first photoconductor, and is configured to charge the surface of the first photoconductor by discharge between the discharging wire and the first photoconductor.

4. The image forming apparatus according to claim 1, wherein in a case where the storage medium is a first storage medium, the wiring portion includes a relay board having a second storage medium configured to store information, a first wiring electrically connecting the first contact portion and the relay board, and a second wiring electrically connecting each of the plurality of second contact portions and the relay board.

5. The image forming apparatus according to claim 1, wherein the wall is an insulator.

6. The image forming apparatus according to claim 1, wherein at least a part of the wall is a conductor.

7. The image forming apparatus according to claim 6, wherein the conductor is electrically grounded.

8. The image forming apparatus according to claim 1, wherein the wall has an inclined surface which is inclined toward a downstream side in the attaching direction as it goes downward and which faces downward.

9. The image forming apparatus according to claim 8, wherein the inclined surface of the wall is provided between the part of the wiring portion and the first cleaner in the cross-section of the photoconductor unit perpendicular to the rotational axis when the first cleaner is at the position the same as the position of the part of the wiring portion in the direction of the rotational axis.

10. The image forming apparatus according to claim 1, wherein the first charger includes a discharging wire which extends in the direction of the rotational axis, which is apart from the first photoconductor, and which is configured to charge the surface of the first photoconductor by discharge between the discharging wire and the first photoconductor.

11. The image forming apparatus according to claim 10, wherein the first cleaner includes:

a cleaning portion configured to clean the discharging wire by contacting the discharging wire, and a portion-to-be-operated configured to be operated by a user so as to move the first cleaner in the direction of the rotational axis and having an upward surface facing upward, wherein a distance between the upward surface of the first cleaner and the wall becomes larger as it goes upward.

12. The image forming apparatus according to claim 11, wherein the part of the wiring portion, the wall, the upward surface of the first cleaner, the discharging wire, and the rotational axis of the first photoconductor are arranged in this order in a gravity direction.

13. The image forming apparatus according to claim 11, wherein the wall is provided between the part of the wiring portion and the upward surface of the first cleaner in the cross-section of the photoconductor unit perpendicular to the rotational axis when the first cleaner is at the position the same as the position of the part of the wiring portion in the direction of the rotational axis.

14. The image forming apparatus according to claim 11, wherein the wall has an inclined surface which is inclined toward a downstream side in the attaching direction as it goes downward and which faces downward, and wherein the inclined surface of the wall is provided between the part of the wiring portion and the upward surface of the first cleaner in the cross-section of the photoconductor unit perpendicular to the rotational axis when the first cleaner is at the position the same as the position of the part of the wiring portion in the direction of the rotational axis.

15. The image forming apparatus according to claim 1, wherein the wall has an inclined surface which is inclined toward a downstream side in the attaching direction as it goes downward and which faces downward.

* * * * *